United States Patent [19]

Holland

[11] 4,282,926

[45] Aug. 11, 1981

[54] COOLING OF FLUID STREAMS

[75] Inventor: Kenneth B. D. Holland, Forestville, Australia

[73] Assignee: James Howden and Company Australia Pty. Limited, Australia

[21] Appl. No.: 14,087

[22] Filed: Feb. 22, 1979

[30] Foreign Application Priority Data

Feb. 24, 1978 [AU] Australia ..... PD3507/78
Jun. 9, 1978 [AU] Australia ..... PD4663/78

[51] Int. Cl.[3] ..... F28D 15/00

[52] U.S. Cl. ..... 165/1; 122/7 R; 122/33; 165/104.27

[58] Field of Search ..... 165/105, 1; 122/7 R, 122/33

[56] References Cited

U.S. PATENT DOCUMENTS

| | | | |
|---|---|---|---|
| 1,690,108 | 11/1928 | Grady . | |
| 1,725,906 | 8/1929 | Gay . | |
| 1,882,750 | 10/1932 | Black | 122/33 |
| 1,887,807 | 11/1932 | Grebe | 122/33 |
| 1,976,462 | 10/1934 | Roe | 122/33 |
| 2,115,548 | 4/1938 | Artsay | 122/33 |
| 2,433,547 | 12/1947 | Dalin | 122/7 R |
| 3,147,742 | 8/1964 | May | 122/7 R |
| 3,229,759 | 1/1966 | Grover . | |
| 3,326,278 | 6/1967 | Cowan . | |
| 3,662,542 | 5/1972 | Streb . | |
| 3,687,612 | 8/1972 | Ernst . | |
| 3,688,838 | 9/1972 | Sturm . | |
| 3,749,158 | 7/1973 | Sazabo . | |
| 3,786,861 | 1/1974 | Eggers . | |
| 3,809,154 | 5/1974 | Heller . | |
| 4,033,406 | 7/1977 | Basiulis . | |
| 4,091,547 | 5/1978 | Leigh . | |
| 4,109,705 | 8/1978 | Bergdehl . | |

FOREIGN PATENT DOCUMENTS

| | | |
|---|---|---|
| 1222310 | 2/1971 | United Kingdom . |
| 1255114 | 11/1971 | United Kingdom . |

*Primary Examiner*—George E. Lowrance
*Attorney, Agent, or Firm*—Bacon & Thomas

[57] ABSTRACT

A method and apparatus for cooling a fluid stream, especially flue gases produced in large volumes in industrial processes. Heat is dumped from the gas stream via the medium of a circulating fluid which is evaporated by a gas stream and then recondensed as it dumps its acquired heat. The fluid is chosen and the rate of recondensation is controlled so that the liquid phase is at a selected saturation temperature which is then the interface temperature in the gas stream.

6 Claims, 2 Drawing Figures

COOLING OF FLUID STREAMS

Figure 1:
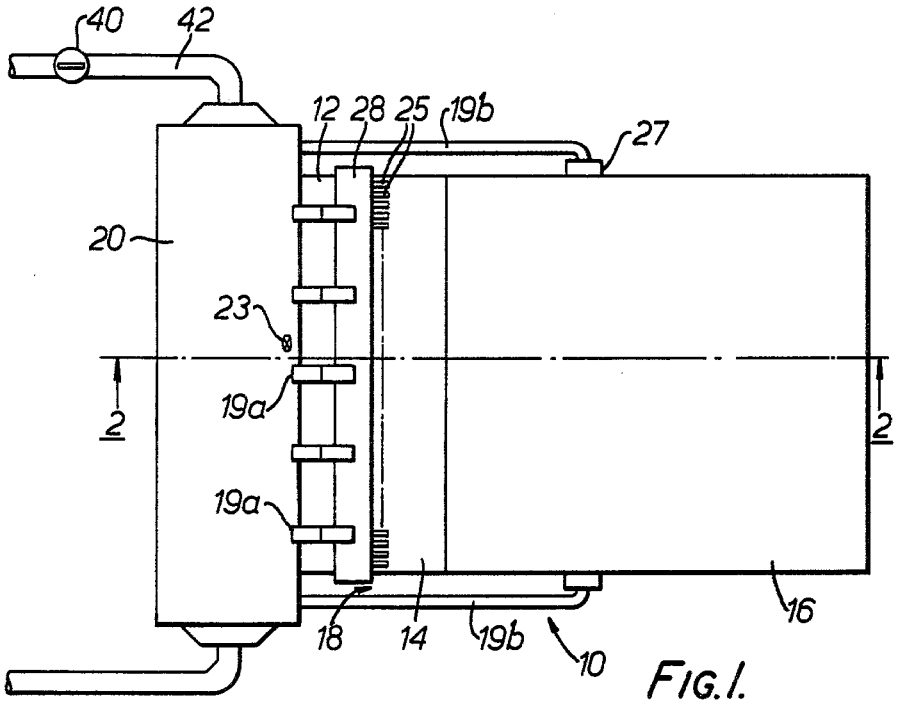

The present invention relates to the cooling of fluid streams and in a particular application provides an improved arrangement for cooling flue gases produced in large volumes in industrial processes.

Conventional techniques for cooling gas streams include attemperation by addition of a cooler fluid to the stream to bring the temperature of the mixture down to the desired level, evaporative spray cooling and use of heat exchange equipment. The first mentioned of these techniques entails a substantial increase of the total volume of cooled gas with a consequent necessity to increase the capacity of all downstream plant. As for evaporative spray cooling, the only liquid normally economically available in sufficient quantity for this purpose is water and the high boiling point of water limits the application of the method to high temperature applications where adequate evaporation can be achieved.

Where the excess heat is to be transferred directly to a cooler fluid by means of a heat exchanger, air or water, initially at ambient temperature, is typically used as the cooling fluid to allow ready dumping of the heat to the surroundings. Such an approach entails difficulties in properly controlling the extent of cooling in the stream both locally and overall, within specified limits. Furthermore, in the event of failure of the flow of cooling fluid, uncooled gas will pass downstream almost immediately.

It is an object of the invention to provide an improved method of and apparatus for cooling a fluid stream such as a flow of gas.

The invention provides a method of cooling a fluid stream, comprising;

directing the stream into heat exchange relationship with the liquid phase of a secondary fluid, whereby to vapourize the liquid;

recondensing the vapourized secondary fluid at a location displaced from said fluid stream; and allowing the secondary fluid to circulate without substantial loss thereof, partly in the liquid phase following said condensation and partly in the vapour phase following vapourization by said fluid stream;

wherein the secondary fluid is chosen and the rate of recondensation controlled whereby the liquid phase of the secondary fluid absorbing heat from said fluid stream is at a selected saturation temperature.

Preferably, said rate of recondensation is controlled as prescribed by controlling the volume rate of flow of a third fluid in heat exchange relationship with the vapour phase of the secondary fluid. Variation of this rate of flow will affect the vapour pressure of the circulating secondary fluid, which will in turn vary the saturation temperature of the liquid phase.

By utilising the inventive combination of steps, the cooling process is not critically dependent for short term maintenance of stream cooling on a continuation of the flow of any fluid to which heat is dumped, as in conventional direct heat exchange cooling. In this case, should circulation of the dump fluid—the third fluid—cease, the cooling action will continue as vapour pressure builds up by a small amount until pressure relief valves open to discharge vapour to waste. Because the saturation temperature of the liquid phase increases relatively slowly with pressure, the performance of the cooler is not significantly altered under these circumstances and operation proceeds satisfactorily until the liquid level falls below the top of the heating surface. This period can be made as long as desired by increasing the amount of stored liquid to provide ample time for corrective action to be taken.

Advantageously, a vigorous circulating flow of the secondary fluid is produced and maintained. Such vigorous circulation ensures that all secondary fluid within the closed circuit does not vary significantly from a single temperature, viz., the saturation temperature of the liquid phase.

The invention also provides apparatus for cooling a fluid stream comprising;

a primary duct for confining said fluid stream;

at least one secondary duct disposed in said primary duct for guiding the liquid phase of a secondary fluid into heat exchange relationship with said fluid stream whereby to permit vapourization of the liquid phase by said stream;

means for recondensing the vapourized secondary fluid at a location displaced from said fluid stream; and means allowing the secondary fluid to circulate without substantial loss thereof, partly in the liquid phase following said condensation and partly in the vapour phase following vapourization by the fluid stream; and means to control said rate of recondensation whereby the liquid phase of the secondary fluid absorbing heat form said fluid stream is at a selected saturation temperature.

The rate control means preferably comprises valve means arranged to control the volume rate of flow of a third cooler fluid in heat exchange relationship with the vapour phase of the secondary fluid.

Figure 2:
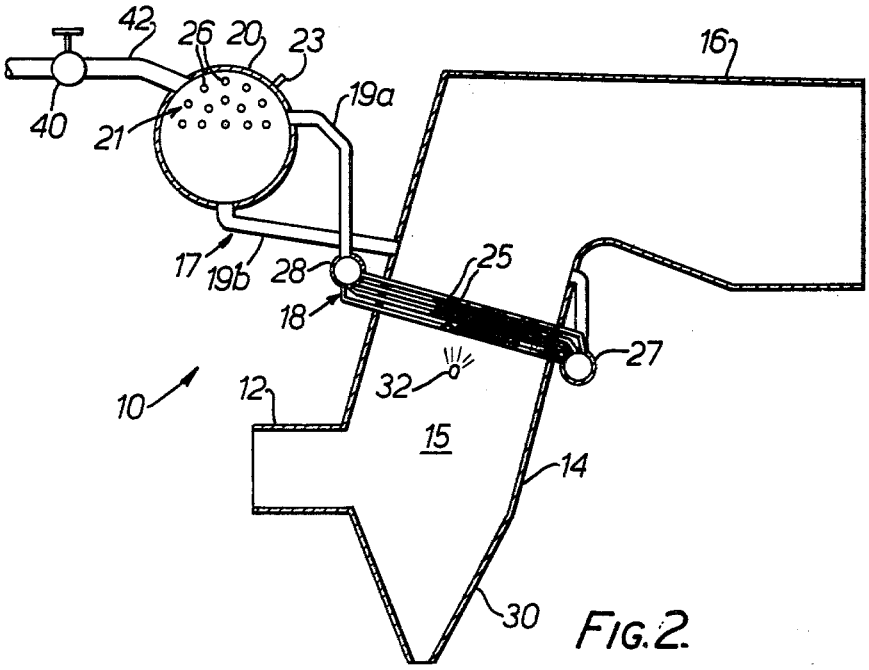

The invention will now be further described by way of example with reference to the accompanying drawings, in which:

FIG. 1 is a schematic plan representation of part of an installation incorporating the inventive apparatus, and FIG. 2 is a cross-section on the line 2—2 in FIG. 1.

The illustrated plant 10 is part of a flue gas cooling installation in an application where it is desired to lower the temperature of the gas prior to its admission to pollution control filter equipment.

A flue gas stream enters by way of a generally horizontal duct 12 to an upright, enlarged duct portion 14 defining a passageway 15 from where the stream passes out horizontally at 16. A first heat exchanger or evaporator 18 having multiple secondary ducts in the form of tubes 25 extends across passageway 15 and is disposed in a fluid flow circuit 17 in series with a combined vapour drum 20 and condenser 21 serving as a further heat exchanger. A circulating secondary fluid in circuit 17 is arranged to take up heat from the gas stream at exchanger 18 and to be thereby evaporated. The vapour is carried along conduits **19*a* to where the heat is dumped to a cooler receiving liquid flowing through multiple tubes 26 forming condenser 21. The vapour is thereby recondensed and condensate which collects in drum 20 returns to evaporative exchanger 18 via conduits 19*b*. Drum 20 includes a pressure relief valve 23** operative to release vapour from the drum at a preset pressure.

As already indicated, both evaporative heat exchanger 18 and condenser 21 comprise respective banks 25,26 of parallel heat conductive tubes by which the respective heat receiving fluid is brought into heat exchange relation with the hotter fluid. Tubes 26 of condenser 21 are supplied with coolant via a duct 42 having a valve 40 by which the volume rate of flow through these tubes may be varied to control the rate of heat extraction from the secondary fluid circulating in circuit 17. In this way, control is exercised over the vapour pressure in circuit 17 and accordingly also over the saturation temperature of the liquid phase in evaporator 18.

Tubes 25 of the evaporator 18 extend between a liquid inlet manifold 27 and a slightly higher vapour outlet manifold 28. This configuration, in which the tubes lie close to the horizontal, can be expected to give the smallest average tube side, or contact surface, temperature by minimizing the increase in saturation temperature due to static head of liquid across the depth of the bank. In conjuction, if warranted, with an underlying ash hopper 30 and an ash blower 32 this arrangement of a tube bank transverse to an upright gas stream passageway further diminishes the chance of the tube bank being fouled by fly ash deposited from the stream.

The gas side surface of the tubes 25,26 may be extended by fins or other means. The tubes 25 should be arranged and spaced to avoid undue erosion by suspended fly ash.

The secondary fluid in circuit 17 is chosen and the rate of recondensation in drum 20 controlled by means of valve 40 so that the liquid phase of the secondary fluid in the evaporator is at a selected saturation temperature, which must of course be lower than the temperature of the hot gas stream entering duct 12.

It will be appreciated that this temperature will then constitute the minimum surface gas contact temperature at tubes 25 of the evaporator.

The ability to readily set a minimum temperature of surface contact at the primary heat exchange step gives rise to certain advantages. In general, and considering the case of cooling a gaseous fluid, a gas cooler must operate to cool the gas when it is too hot, but avoid cooling the gas when it is not. In many cases, moreover, it is important to avoid cooling below a specific temperature at which corrosive or other undesirable effects may occur as a result of a particular constituent of the gas stream. With conventional gas coolers the control of the cooling fluid flow must be varied to suit the measured gas temperature, and since this may vary over the stream due to stratification, a large array of temperature sensing elements is required, some of which may signal that no cooling is necessary while the remainder call for varying amounts. This situation requires a relatively complex control system and, since the cooling action must be matched to the hottest part of the stream, will result in over-cooling when temperature stratification exists in the gas.

With the method of the invention, since there is no requirement to vary flow in dependence on gas temperature, the prior requirement to measure the gas temperature at many points is obviated. If monitoring is thought desirable, one can simply measure the vapour pressure of the intermediate two phase fluid and control the pressure in the manner described to maintain the selected saturation temperature of the liquid phase. Such a system is inherently more reliable than the alternative described above.

In the event that the average temperature of the gas stream entering duct 12 is above the heat exchange surface contact temperature at tubes 25 some cooling will take place. However the colder parts of the gas stream will not be cooled as much as the hotter parts due to the smaller gas-to-fluid temperature difference. Moreover the location of a cold segment of the gas stream has no bearing on the degree of cooling it experiences. These effects do not operate to the same extent in a conventional unit because there the surface contact temperature is not constant and uniform; cooling of the hotter gas is reduced and of the colder gas increased. Thus, in the inventive case, temperature gradients in the gas stream are smoothed out to a considerable extent, a circumstance which has a benificial effect on the performance of downstream plant.

The surface of contact in the primary heat exchange step may be maintained substantially uniform and constant at the selected saturation temperature by the natural circulation characteristics of the circuit 17. The uniform surface temperature permits the performance of the unit to be understood with confidence even though the magnitude and location of temperature variations in the gas system are not known in detail. This is not the case for a conventional gas cooler because the available design methods apply only to average temperature and consequently to predict the degree of cooling or otherwise of individual parts of the gas stream requires that the gas stream temperature distribution be specified in detail, as well as the ambient temperature, and the results would apply to the specific conditions only.

It has earlier been indicated that the condenser should preferably be located above the evaporator. More specifically, drum 20 incorporating tubes 26 should be situated so that the liquid level is high enough to produce sufficient natural circulation to avoid reduced heat transfer at high evaporator load due to vapour blanketting. On the other hand it is desirable for the liquid level to be as low as possible to allow the highest vapour pressure in the condenser 21. The advantage of this is that either the mean temperature between vapour and coolant in tubes 26 will be maximized, with a consequent reduction in heating surface, or the temperature rise of the coolant can be increased, thus reducing the required capacity of the recondensing cooling system.

There is a further advantage associated with a low liquid level. As a fail-safe safety feature, the pressure relief valve(s) 23 on the vapour drum may be set so that, in the event of failure of the coolant flow in tubes 26, vapour will be discharged to atmosphere when the drum pressure rises above atmospheric pressure. If the vapour pressure during normal operation is high, then the vapour side temperature rise when the relief valves blow will be small and the increase in the downstream temperature of the cooled gas stream will be minimized.

To allow time for operator action under the circumstances just described a reasonable liquid capacity should be provided in drum 20. A high level of gas cooling would then be maintained until the liquid level fell below the level of the higher tubes in the evaporator bank 25. What is considered a reasonable capacity will depend on layout and other considerations.

To avoid the necessity to have a coolant system for supplying fluid such as water to condenser tubes 26, an alternative is to provide an atmospheric condenser. This comprises a finned tube heat exchanger over which ambient air is circulated by propeller-type fans, the cooling rate of flow of the air being controlled in dependence upon the required saturation temperature at the evaporator tubes.

One potential difficulty is the possibility that on cold nights or at low heat loads the vapour pressure in the condenser might collapse due to natural convection and radiation to the atmosphere. This would permit the evaporator to cool the gas to an undesirably low temperature. This possibility could be avoided by isolating the condenser from the evaporator by spring loaded valves which would open to admit vapour to the condenser when the pressure in the drum corresponded to the required minimum saturation temperature in the evaporator tubes. Because the condenser would normally operate at a lower pressure than the evaporator, a pump would be required to return the condensate to the evaporator via a non-return valve. The pump would be controlled by the liquid level in the vapour drum. With this scheme the condenser/drum unit could of course be located remote from the evaporator and at a lower level if desired.

I claim:

1. A method for cooling a gas stream in a manner to provide a time lag between a failure of a cooling fluid supply and a consequent rise in the discharge temperature of the said gas stream comprising:

passing the gas stream through a duct into heat exchange relationship with the liquid phase of a secondary fluid in a primary heat exchanger whereby to vaporize the liquid;

recondensing the vaporized secondary fluid by passing it through a secondary heat exchanger into heat exchange relationship with a third fluid which is introduced into the secondary heat exchanger at ambient temperature and which exits therefrom without having undergone a phase change;

allowing the secondary fluid to circulate between the primary and secondary heat exchangers substantially without loss of the secondary fluid unless the pressure of the secondary fluid exceeds a predetermined value which is above atmospheric pressure, the secondary fluid being substantially in the vapor phase when passing from the primary to the secondary heat exchanger and being substantially in the liquid phase when travelling from the secondary to the primary heat exchanger;

the secondary fluid being so chosen and the rate of condensation in the secondary heat exchanger being so controlled that the pressure of the secondary fluid is normally maintained below the said predetermined value; and, in the event that the third fluid stream fails, venting the vaporized secondary fluid to maintain the pressure of the secondary fluid below the said predetermined value.

2. A method as claimed in claim 1 in which the secondary fluid travels from the primary heat exchanger to the secondary heat exchanger through a first laterally confined discrete conduit or group of conduits and returns to the primary heat exchanger through a second laterally confined discrete conduit or group of conduits.

3. A method according to claim 1 in which the secondary heat exchanger is positioned above the location of the primary heat exchanger.

4. Apparatus for cooling a gas stream in a manner to provide a time lag between a failure of a cooling fluid supply and a consequent rise in the discharge temperature of the said gas stream comprising:

a duct for confining the gas stream;

primary heat exchanger disposed in the said duct for guiding the liquid phase of a secondary fluid into heat exchange relationship with said gas stream to permit vaporization of the liquid phase by said stream;

secondary heat exchanger to bring the vapor phase of the secondary fluid into heat exchange relationship with a third fluid which enters the secondary heat exchanger at ambient temperature and does not undergo a phase change while passing through the secondary heat exchanger;

conduit means to carry the secondary fluid from the primary heat exchanger to the secondary heat exchanger in a vapor state and from the secondary heat exchanger to the primary heat exchanger in the liquid state substantially without loss of the secondary fluid unless the pressure of the secondary fluid exceeds a predetermined value which is above atmospheric pressure; and means to control the rate of condensation of the secondary fluid such that the pressure of the secondary fluid is normally below the said predetermined value and valve means to vent the secondary fluid from the secondary heat exchanger and/or from the said conduit means in the event that the flow of the third fluid in the secondary heat exchanger is insufficient to prevent the pressure thereof exceeding the said predetermined value.

5. Apparatus as claimed in claim 4 in which the conduit means comprise a first laterally confined discrete conduit or group of conduits for carrying the secondary fluid in the vapor phase and a second laterally confined discrete conduit or group of conduits for carrying the secondary fluid in the liquid phase.

6. Apparatus as claimed in claims 4 or 5 in which the secondary heat exchanger is positioned above the location of the primary heat exchanger.

* * * * *